United States Patent [19]

Baran

[11] Patent Number: 4,912,824

[45] Date of Patent: Apr. 3, 1990

[54] ENGRAVED MICRO-CERAMIC-COATED CYLINDER AND COATING PROCESS THEREFOR

[75] Inventor: Andrew M. Baran, Richmond, Va.

[73] Assignee: Inta-Roto Gravure, Inc., Richmond, Va.

[21] Appl. No.: 322,948

[22] Filed: Mar. 14, 1989

[51] Int. Cl.[4] ..... B22F 7/04

[52] U.S. Cl. ..... 29/121.2; 29/120; 29/121.1; 29/130; 29/132; 101/170; 101/348

[58] Field of Search ..... 29/120, 121.1, 121.2, 29/129, 130, 132; 101/150, 153, 170, 348; 204/25, 38.6; 427/264, 265; 35/270

[56] References Cited

U.S. PATENT DOCUMENTS

| | | | |
|---|---|---|---|
| 2,776,256 | 1/1957 | Eulner et al. | 204/25 |
| 3,165,179 | 1/1965 | Shapland | 29/130 |
| 3,660,252 | 5/1972 | Giori | 204/17 |
| 3,923,610 | 12/1975 | Bergin et al. | 204/25 X |
| 4,090,469 | 5/1978 | Roberts | 118/410 |
| 4,334,966 | 6/1982 | Beach et al. | 204/25 |
| 4,391,879 | 7/1983 | Fabian et al. | 101/170 X |
| 4,503,769 | 3/1985 | Andersen | 204/25 X |
| 4,537,127 | 8/1985 | Fadner et al. | 101/348 X |
| 4,567,827 | 2/1986 | Fadner | 101/141 X |
| 4,793,041 | 12/1988 | Jenkins et al. | 29/121.1 |

*Primary Examiner*—Timothy V. Eley
*Assistant Examiner*—Frances Chin

[57] ABSTRACT

An engraved micro-ceramic-coated cylinder and a coating process therefor, for use in converting industries, comprises a metal base cylinder having a metal layer disposed thereupon, having the metal layer engraved with a cell pattern and a protective/affinitive stratum of metal plated thereover, and having the surface of the protective/affinitive stratum abrasion treated and a ceramic coating applied thereover.

32 Claims, 2 Drawing Sheets

ENGRAVED MICRO-CERAMIC-COATED CYLINDER AND COATING PROCESS THEREFOR

This invention relates to engraved cylinders used in the so-called converting industries for the application of inks, varnishes, paints, adhesives, coatings, and the like to webs and similar substrates, for example in web converting equipment for coating of webs and sheet material, for instance paper, cardboard, cloth, flooring materials, wall papers, etc. In certain particular uses, such cylinders are also called gravure cylinders and applicator cylinders. Specifically, the engraved cylinders are used as carriers of the coating application liquids for transfer and application thereof to respective substrates in rotating machinery (for instance gravure and flexographic machinery).

In recent years, the recognition of the dangers of adverse environmental impact and the seriousness of the detrimental effects on people (and lifeforms in general) resulting from the use of solvent-based application liquids has caused increasing use of and conversion to water-based application liquids and has, therewith, necessitated the employment of component materials particularly suited to such water-based coating liquids in the converting industries. The latter liquid-component materials generally include various rather abrasive coating components (for instance titanium oxide). Consequently, wear of engraved cylinders has become a serious problem, as the useful life of conventional cylinder surfaces has been found to be drastically curtailed when operated with water-based application liquids that necessarily comprise comparatively highly abrasive materials.

Conventional engraved cylinders have generally surfaces of materials that are relatively easily abraded. A customary surface material is copper that is sometimes further plated with chromium. Ceramic-surfaced engraved cylinders, that are significantly more resistant to abrasion, have come into use in recent times, yet they have suffered from serious limitations and deficiencies in that the engraved cell pattern in their surfaces has been practically engraveable only by means of lasers.

Laser-engraving into ceramic material is not only relatively slow and therefore costly, but the engraved cell structures are practically limited to approximately circular holes of significantly indeterminate irregular periphery, depth, bottom shape, and thusly also cell volume. Aside from the indeterminate laser-engraved cell volumes, maximum possible cell volume density over the cylinder surface is significantly curtailed by the inherent upper limits to the practical packing density of such holes.

Moreover, it has been found that the cells of laser-engraved ceramic cylinder surfaces tend to clog up and offer relatively unfavorable release and cleaning characteristics as a consequence of the indeterminate irregularity and roughness of wall and bottom surfaces of cells.

In spite of the hereinabove indicated well-known disadvantages of laser-engraved ceramic-surfaced cylinders, their use has increased for lack of alternatives to provide tolerable wear characteristics particularly in applications involving larger production runs. For instance, it has been found in general that ceramic-surfaced cylinders provide a useful life that is up to about seven to eight times as long as the life of chrome-plated copper-surfaced cylinders in comparable uses when water-based (abrasive) coating liquids are used. Industry has been forced to adopt laser-engraved ceramic-surfaced cylinders in spite of their high production cost (as much as four to 6 times higher than the cost of conventional chrome-plated copper cylinders), that is largely due to the slowness of the laser engraving procedure, as conventional cylinders are often unable to last through even a single larger production run.

Mechanically engraved steel cylinders which are coated with ceramic material are sometimes used for relatively undemanding applications. However, an inherent consequence of mechanical knurling (mechanical engraving) is the therewith associated spiral effect and a distortion of the cylinder that prevents use of such cylinders for higher quality applications.

Other conventional gravure cylinders include chemically etched (engraved) and electronically engraved copper-layered cylinders, that are often also chromium plated, and that do not provide adequate wear properties in use with water-based coating liquids. Similarly engraved copper-layered cylinders that are coated with ceramic have been found to lose cell structure to an unacceptable degree and, moreover, the resulting grossly inadequate ceramic adhesion has resulted in frequent early failures in use due to separation and flaking of the ceramic coating.

The patent art is replete with methods for coating of cylinders that are engraved for uses as hereinbefore indicated. Customarily these methods are predominantly based on the application of electroplating of copper layers that are variously treated during and after plating to provide surface characteristics of appropriately high quality and that are engraved (or etched) for the intended application.

For instance, U.S. Pat. No. 2,776,256 to Eulner et al describes a number of processes for making of intaglio printing cylinders, including a variety of copper plating methods and treatments. In another example, U.S. Pat. No. 3,660,252 to Giori describes a method of making engraved printing plates including copper, nickel, and chromium plating. A method of copper plating gravure cylinders is disclosed in U.S. Pat. No. 3,923,610 to Bergin et al, wherein steel or aluminum cylinders form a substrate for a layer of copper that is etched with a plurality of small cells. Another method of copper plating gravure cylinders is described in U.S. Pat. No. 4,334,966 to Beach et al, wherein the copper plating is especially adapted to receive electronic engraving utilizing a diamond stylus forced against a copper outer layer. Also U.S. Pat. No. 4,567,827 to Fadner discloses a copper and nickel plated ink metering roller of a hardened steel base roller substrate, the base roller being engraved with a plurality of patterned cells over which the plating is applied. Fadner also mentions commonly-used hydrophilic roller materials including ceramic materials such as aluminum oxide and tungsten carbide among wear-resistant materials available for manufacture of an inking roller.

It is not surprising that relatively little use of ceramic surfacing of gravure cylinders has been made in the art for higher quality applications, in view of the hereinabove described known deficiencies associated therewith. Cell properties and surface qualities, and consequently performance of gravure cylinders constructed with ceramic surfaces have been, heretofore, incapable of fulfilling the strict requirements of quality coating uses.

In view of the foregoing, it is an object of the present invention to provide an engraved micro-ceramic-coated cylinder and a coating process therefor that overcome the foregoing deficiencies. More particularly, it is an object of this invention to provide an engraved cylinder having a ceramic surface that is resistant to abrasion particularly from abrasive components of water-based application liquids to the extent of having a useful operating life that is a multiple of the life of known copper-surfaced engraved cylinders in comparable uses and that offers properties of surface and engraved cell quality and conformance to customary specifications thereof that are substantially equivalent to or better than the properties of conventional high quality copper-surfaced engraved chrome plated cylinders and that significantly exceed the best obtainable quality and operating characteristics of ceramic-surfaced laser-engraved cylinders at a manufacturing cost that is significantly below the cost of the latter.

SUMMARY OF THE INVENTION

In accordance with principles of the present invention, an engraved micro-ceramic-coated cylinder and a coating process therefor comprises a metal base cylinder having a metal layer disposed thereupon, said metal layer facilitating engraving with a cell pattern, having the metal layer engraved with an accurate cell structure, thusly forming a metal substrate for a protective/affinitive metal stratum which is subsequently deposited thereover, and having the protective/affinitive stratum coated with a ceramic coating applied thereover.

It is a feature of the invention that the engraved cylinder provides a ceramic surface that is resistant to abrasion to the extent of providing useful life times that are a multiple of the life times obtainable from copper-surfaced cylinders when used with abrasive water-based application liquids, while providing properties of surface and gravure cell quality that are substantially equivalent to or better than the properties of conventional higher quality copper-surfaced engraved chrome plated cylinders.

It is another feature of the invention that the engraved ceramic-surfaced cylinder, having been engraved with accurate cells in its substrate, provides a ceramic surface, ceramic cell volume density, and cell release and cleaning properties, and other characteristics that are substantially in conformance with specifications customary for conventional copper-surfaced engraved cylinders, which characteristics significantly exceed the customary quality and specification conformance of ceramic-surfaced laser-engraved cylinders at a manufacturing cost that is significantly below the cost of the latter.

Still another feature of the invention is the provision of a protective/affinitive metal stratum over a cell-engraved metal substrate to provide strong affinitive adhesion with respect to the substrate and with respect to the subsequently applied superstrate in form of a ceramic coating.

Yet another feature of the invention is the provision for an accurately increased cell volume in engraving thereof and the provision of an accurately controlled compensating diminution thereof during subsequent layer depositions and coatings, thusly achieving precisely predictable conformance with cell volume density requirements for a finished cylinder.

These and other features which are considered to be characteristic of this invention are set forth with particularity in the appended claims. The invention itself, however, as well as additional objects and advantages thereof, will best be understood in the following description when considered in conjunction with the accompanying drawings.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
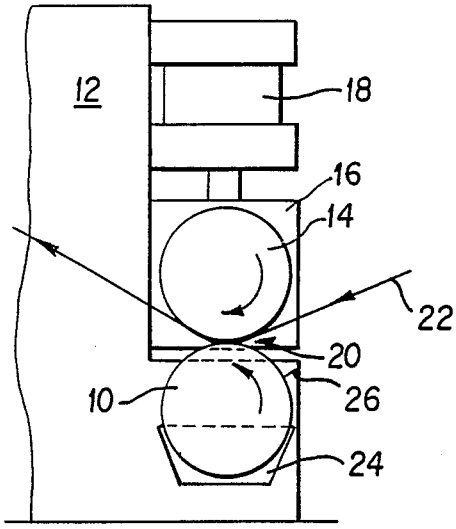
FIG. 1 is a schematic side end elevation view of an example of a typical application of an engraved cylinder of this invention in a direct gravure printing/coating machine.

Referring now to the drawings, FIG. 1 shows schematically a typical application of an engraved cylinder of this invention in a direct gravure printing/coating machine. An engraved cylinder 10, that is disposed in a printing/coating machine 12, is revolvably borne therein in substantially horizontal orientation. A back-up roll 14 is adjustably and revolvably borne in a lift arrangement 16 that serves for adjustment and lift-up thereof. Lift arrangement 16 includes a lift cylinder 18. Engraved cylinder 10 and back-up roll 14 form a nip region 20 therebetween to engage a web 22 that is to be coated by the equipment. A lower portion of engraved cylinder 10 is submerged in a coating liquid contained in a liquid retention pan 24. As further customarily provided, a doctor blade 26 is disposed in sliding contact with gravure cylinder 10 for wiping and metering purposes.

In operation, web 22 is driven through nip region 20 by the coacting rotation of engraved cylinder 10 and back-up roll 14. The surface of engraved cylinder 10 is wetted by the coating liquid in pan 24, is wiped by doctor blade 26, and transfers liquid carried by the gravure cell pattern in the peripheral surface of cylinder 10 onto the lower surface of web 22.

Figure 2:
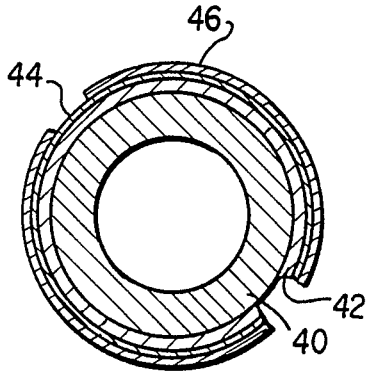
FIG. 2 is a schematic, partially fragmented section of a cylinder of the invention.

Referring now to FIG. 2, wherein engraved cylinder 10 is shown schematically in section to indicate its cylindrical shell strata, cylinder 10 comprises a metal base cylinder 40, a metal substrate 42 disposed thereupon that is engraved with an appropriate cell pattern, a protective/affinitive stratum 44 (deposited over engraved substrate 42) whose surface is abrasion treated with ultra fine grit (for instance by sandblasting), and a superstratum in form of a micro-ceramic coating 46 thereover.

Metal base cylinder 40 provides a supporting structure between a cylinder shaft (that is not shown here) and the indicated cylindrical shell strata which, in combination, result in appropriate features and properties for advantageous use as engraved cylinder 10. Substrate 42 is a metal layer of adequate depth and suitable hardness to carry an appropriate cell pattern that is engraved therein. Electroplated or otherwise deposited hard copper is a preferred material for substrate 42, although other metals and metal alloys, such as for instance silver, zinc, iron, brass, etc. are suitable under certain circumstances. The surface of substrate 42 is ground and polished prior to engraving to achieve a suitable surface diameter, concentricity thereof, and surface finish. The hardness properties of substrate 42 facilitate appropriately distortion-free engraving thereof so that engraving, which is preferably performed by impressing a stylus into the surface of substrate 42 (electronic engraving), does not cause excessive raising of ridges in the lands that surround engraved cells.

Substrate 42 is engraved with a particular engraved cell pattern that conforms to the requirements of a particular application, except that the engraved cell volume (and volume density) is increased by a precise amount to compensate for the controlled diminution thereof during subsequent processing, as will be further described hereinafter.

Over engraved substrate 42 is deposited protective/affinitive stratum 44 in a metal that provides strong affinitive adhesion with respect to substrate 42 and with respect to micro-ceramic coating 46, as well as providing a protective layer to protect engraved substrate 42 from the effects of the subsequent abrasion treatment and micro-ceramic coating process (that employs flame-spraying or plasma-spraying). In this respect, as hereinafter used in this application "protective", when used in reference to stratum 44 means the protective and/or affinitive structure described herein. It is particularly imperative that the material of stratum 44 provides strong affinitive adhesion in respect to micro-ceramic coating 46. In order to further enhance and strengthen this latter affinitive adhesion, the surface of protective/affinitive stratum 44 is abrasion treated (without breaking through stratum 44) with an ultra-fine grit that is, for instance, of a grade conventionally utilized in watchmaking industries and the like. Such abrasion treatment is performed, for example, by sandblasting. A preferred material for protective/affinitive stratum 44 has been found to be nickel that is deposited over engraved substrate 42 (which is preferably hard copper), although other metals, bimetallic platings, and alloys are also usable, provided the hereinbefore indicated protective and affinitive adhesion characteristics are adequate. For instance, bimetallic deposits comprise two dissimilar metal layers, having strong mutual adhesion or bonding, the individual metals being specifically selected to offer strong adhesion with respect to adjacent substrate 42 and adjacent micro-ceramic coating 46, respectively. The hereinabove discussed deposition of protective/affinitive stratum 44 is preferably performed by electroplating, although other conventional deposition processes are usable.

A standard commercial grade of micro-ceramic coating 46 (as a superstratum) is provided by plasma-spraying or flame-spraying of an appropriate refractory material mix that preferably comprises predominantly aluminum oxide. Also, this mix preferably comprises a further minor component, namely nickel or nickel oxide for further enhancement of binding and affinitive adhesion characteristics particularly also in relation to protective/affinitive stratum 44. A preferred nominal composition is about 99.5% aluminum oxide and about ½% nickel and/or nickel oxide. Such a product can be obtained from Bay State Abrasives (Dresser Co.) as TYPE PP33. Nickel and/or nickel oxide as minor components of the mix have been especially effective in further enhancement of the latter adhesion, particularly when protective/affinitive stratum 46 comprises nickel at least in its surface, and thusly represents a preferred choice in at least the latter situation. Alumina/titania compositions comprising predominantly aluminum oxide and a minor component of titanium oxide as well as other commercially available complex refractory oxide mixes have also been found suitable for micro-ceramic coating 46, wherein minority components of a metal (and/or its oxide) corresponding to the metal comprised in at least the surface of stratum 44 may be advantageously included. A suitable such composition is nominally about 97.5% aluminum-oxide and about 2 ½% titanium oxide. Such a product is in accordance with GE Specification A50TF87CLB and can be obtained from Bay State Abrasives (Dresser Co.) as TYPE PP32.

Figure 3:
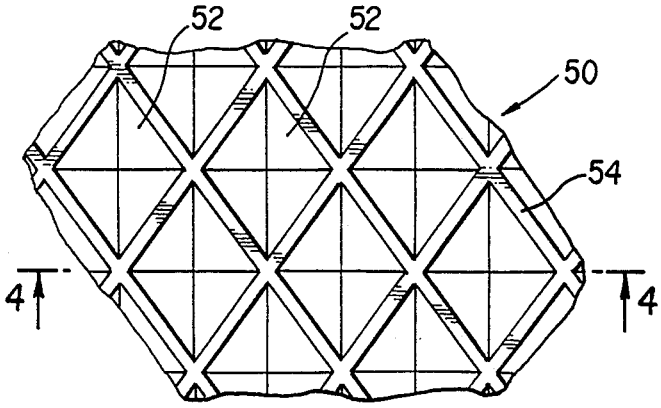
FIG. 3 is a schematic view of a typical cell pattern used in this invention.
Figure 4:
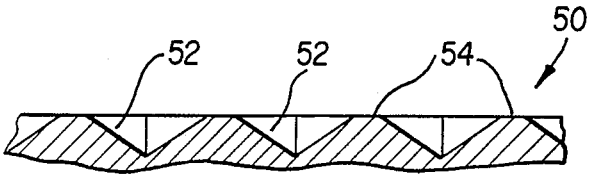
FIG. 4 is a schematic section perpendicular to a surface of the cell pattern along section line 4 shown in FIG. 3.

Referring now to FIGS. 3 and 4, a typical engraved cell pattern is depicted therein. The shown cell pattern is representative of the kind of patterns preferred for engraved cylinders of the present invention, whose cells are generally quadrangular—in particular having square or diamond shapes; the latter are also variously called "elongated" or "compressed" cells. Hexagonal cell shapes also provide desirable cell pattern characteristics for high cell densities. Other cell shapes may also be utilized, although useful higher cell volume densities are practically achievable only with the above indicated cell shapes. As shown here, a cell pattern 50 comprises a plurality of cells 52, whose size and frequency is selected to conform to particular required coating characteristics based on the volume of coating liquid needed (to be carried by the cell pattern) to meet coating density requirements for a particular web material. Lands 54 forming the outer surface of cell pattern 50 separate individual cells. To provide an indication of size magnitudes of typical cells, cell widths and lengths are, for instance of the order of about 40 to 100 microns, having lands 54 that are, for instance, about 10 to 15 microns wide. Depths of cells, for example, are about 40 to 50 microns. It should be recognized, however, that cell and land dimensions (and shapes) are established by requirements of a particular application for a gravure cylinder and are, therefore, dimensioned accordingly.

A variety of processes for engraving of cell patterns are known and used; for instance, mechanical knurling and milling, chemical etching, etc. A preferred method of creating cell patterns for engraved cylinders of the present invention uses so-called electronic engraving that employs an appropriately shaped hard tool bit or stylus to impress cells into the surface under electronic computer feed control. A diamond crystal stylus, having a pyramid-shaped tip, is generally employed therein.

As hereinbefore described, the engraved cylinder of the present invention is not engraved with a cell pattern upon its outer surface (as has been customary practice), but it is engraved with a cell pattern in substrate 42 (FIG. 2). As also indicated hereinbefore, the thusly engraved cell pattern is engraved to have a cell volume (and cell volume density) that is increased by a precise amount over that specified for a particular application to compensate for the controlled diminution thereof during subsequent deposition and coating processing in order to accurately conform to the requirements of a particular application. It will be understood that protective/affinitive stratum 44, which is deposited subsequently over engraved substrate 42, and that is abrasion treated with ultra fine grit thereafter, as well as the superstratum in form of micro-ceramic coating 46 coated thereover reduce the available cell volume in respect to the cell volume originally engraved into substrate 42. Accurate control in the application and treatment of stratum 44 and micro-ceramic coating 46 results in accurately predeterminable thicknesses thereof and, consequently in predictable precise cell volumes and cell volume densities in the final surface of engraved cylinder 10.

To more particularly illustrate the present invention, the following describes an example of preferred engraved cylinder strata and a coating process therefor:

A metal base cylinder 40 (for instance of steel or aluminum) is electroplated with a substrate 42 of hard copper. The hard copper substrate has a preferred thickness of 0.010 inches, but may have a minimum thickness of approximately 0.005 inches or somewhat less, wherein no actual limit to a maximum thickness exists, except for practical economical reasons due to plating time and cost. The hardness of the copper substrate is within the approximate range of 190 to 210 Vickers and preferably about 200 Vickers. After plating, the copper substrate is usually ground and polished, as customary before engraving with an appropriate cell pattern. A cell pattern in form of a plurality of accurate cells is engraved into the copper substrate having a cell volume (and cell volume density) that is increased by an accurate amount over that specified by a particular application, which amount is determined by the diminution of cell volume in the course of further processing. A preferred amount for this increase is thirty percent more cell volume than specified for the finished engraved cylinder.

It should be emphasized that the cell volume of a finished engraved cylinder is rather critical for each particular coating application, whereby this criticality customarily imposes a permissible cell volume tolerance range of a maximum of about five percent (of original volume specified) in many applications. However, a tolerance of plus or minus one percent of the original volume specified is preferred and it is considered essential in applications demanding higher quality coating, printing, and the like. Engraved cylinders in accordance with principles of this invention are able to conform to these tolerance specifications. In particular, the specific example described here fulfills the higher precision tolerance requirement of providing a finished cylinder having a cell volume within plus or minus one percent. It will be appreciated that engraving and the subsequent layer deposition, abrasion treatment, and ceramic coating steps need to be precisely controlled in view of the tight tolerance requirements.

In respect to the particular example, engraving of a cell pattern (having a thirty percent increased cell volume over the finished volume specified) is performed by electronic engraving employing a diamond stylus. Thereafter, a stratum of nickel is deposited over the engraved copper to a controlled thickness of 0.002 inches for protection of the copper layer from the subsequent abrasion treatment (for instance by sandblasting) and to provide strong adhesion for the following coating with ceramic material. The nickel stratum is abrasion treated, for example by means of an ultra fine grade grit sandblast that penetrates and partially abrades or erodes the nickel surface, but does not break through the nickel layer (leaving at least about 0.0004 to 0.0005 inches of thickness of nickel in locations of deepest sandblast penetration). The resulting surface is coated with micro-ceramic material to provide a micro-ceramic superstratum of a preferred thickness between 0.001 and 0.0012 inches. The resulting ceramic surface coating has a surface finish in the approximate range of 100 to 135 microinches rms and a macrohardness of about Rn15-83-86.

More generally, when utilizing the particular materials indicated in the above example, but when specifications are slightly relaxed, the stratum of nickel may have a thickness in the range between about 0.002 and 0.003 inches (0.002 preferred) and the thickness of the micro-ceramic superstratum coating may range between approximately 0.0008 and 0.0015 inches.

The hereinbefore indicated diminution of the cell volume of the engraved gravure cell pattern during subsequent coating and treatment of shell strata is a function of the thicknesses of these strata. Therefore, it should be understood that the hereinbefore indicated increase of cell volume of cell pattern 50 engraved in substrate 42 is adapted to any changes in the thicknesses of protective/affinitive stratum 44 and micro-ceramic coating 46, such changes being made in controlled manner. In particular for instance, such changes may be advantageous in consequence of a use of different metals for stratum 44, which may, for example, comprise bimetallic layers such as an underlayer of silver and an overlayer of nickel. Additionally or alternatively, a nickel-silver alloy can be deposited for reasons of particular enhancement of the hereinbefore described affinitive adhesion in relation to substrate 42 and to micro-ceramic coating 46. In this respect, for instance, certain engraved cylinder applications for use with special coating liquids may be more advantageously conformed to by adapting the ceramic refractory material composition of coating 46 to particularly suit such liquids. Consequently, affinitive adhesion between stratum 44 and micro-ceramic coating 46 may be advantageously adapted and enhanced by appropriate bimetallic and/or alloy depositing of stratum 44 that may increase the thickness thereof. Therefore, the aforesaid increase of (engraved) cell volume has to reflect any thickness increase in stratum 44 (and commensurately also any thickness increase in coating 46).

Figure 5:
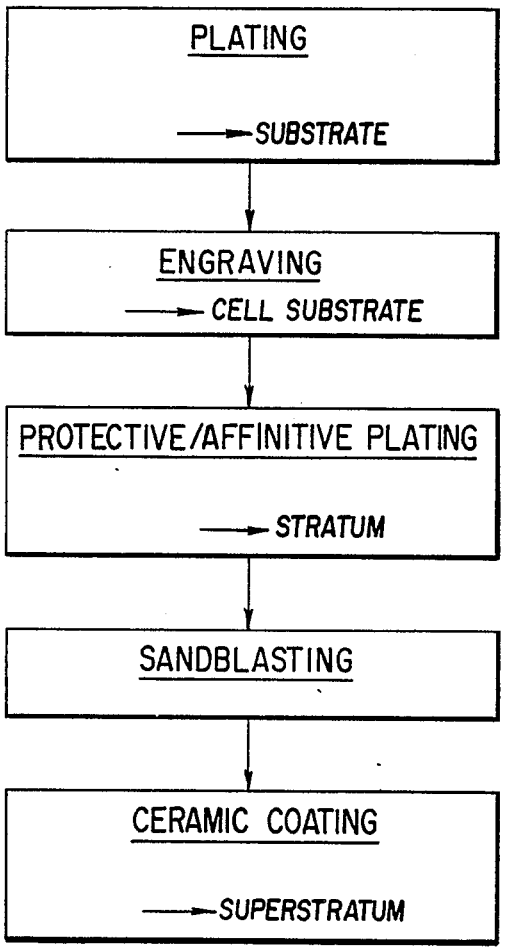
FIG. 5 is a diagrammatic representation of the coating process of the invention.

Referring now to FIG. 5, the schematic diagram of the overall coating method for an engraved cylinder in accordance with this invention depicted therein summarizes salient steps of the applied process. As hereinbefore described particularly also in conjunction with FIG. 2, the coating method to provide an engraved cylinder according to principles of this invention is applied to a metal base cylinder 40 that customarily provides a supporting base structure for such cylinders. The coating process comprises an application and build-up of several shell strata upon base cylinder 40, including an engraved cell pattern in substrate 42, and further including a wear and abrasion resistant outermost superstratum in form of micro-ceramic coating 46 whose surface includes a cell pattern originating in the cell pattern engraved in substrate 42, wherein the cell volume in coating 46 is predictably diminished by a precisely controlled amount in relation to the engraved cell volume in substrate 42.

More particularly, as indicated in FIG. 5, the coating process comprises the following steps, in the order indicated:

(a) depositing, plating, or otherwise providing a metal layer over the outer surface of base cylinder 40 to form substrate 42 for engraving of a cell pattern therein, the metal of said substrate having appropriate properties to facilitate subsequent cell pattern engraving thereinto so that the cylindrical surface of substrate 42, that remains subsequent to said engraving, remains substantially undistorted thereby, and grinding/polishing the outer cylindrical surface of substrate 42 prior to said engraving;

(b) engraving into substrate 42 a cell pattern;

(c) plating or otherwise depositing over engraved substrate 42 a protective/affinitive stratum 44 of metal, wherein the stratum material (or materials) is selected to provide an affinitive adhesion with respect to substrate 42 and with respect to the micro-ceramic coating 46 that is subsequently applied over stratum 44;

(d) abrasion treating of the surface of protective/affinitive stratum 44 so that mutual affinitive adhesion with respect to the subsequently applied micro-ceramic coating 46 is enhanced; and (e) coating a superstratum of ceramic material over protective/affinitive stratum 44 to result in micro-ceramic coating 46, wherein said ceramic material comprises components to provide affinitive adhesion with respect to protective/affinitive stratum 44.

Outstanding features and advantages of the engraved cylinder and the coating process therefor according to principles of this invention include the high wear and abrasion resistance afforded by the ceramic coating that provides a useful life time which is a multiple of the life time of conventional gravure cylinders not having an outer ceramic surface. This abrasion resistance is particularly beneficial in engraved cylinder applications utilizing water-based application liquids that contain highly abrasive components. Moreover, even though existing engraved cylinders having ceramic outer surfaces offer similar life times, hitherto it has been practically feasible to provide usable gravure cell patterns thereupon only by engraving of the ceramic surface with a laser beam, which procedure is not only slow and expensive, but also is incapable of providing cell shapes, quality characteristics thereof, and cell volume densities high enough to be comparable to those customarily specified for conventional non-ceramic surface cylinders. In comparison, engraved cylinders according to the present invention provide such properties in conformance with customary specifications even for higher quality coating applications at a fraction of the cost of laser-engraved ceramic-surfaced cylinders by virtue of their unique structure and the manufacturing process utilized therefor.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. An engraved cylinder for use as a carrier for transfer and application of coating liquids, comprising:

a base cylinder for providing a supporting structure for cylindrical shell strata disposed thereupon;

a substrate disposed upon said base cylinder, said substrate being suited for having cells engraved therein;

said substrate having an engraved pattern of cells thereon to form an engraved substrate wherein each cell has a given cell volume;

a protective stratum deposited upon said engraved substrate, said protective stratum having an abraded outer surface; and, a superstratum of a ceramic coating over the abraded surface of said protective stratum, said superstratum providing on said engraved cylinder a finished cell pattern of finished cells wherein each finished cell has a given finished-cell volume, said finished cell pattern conforming to said engraved pattern of cells, but wherein said finished-cell volumes are less than the cell volumes of the cells in said engraved pattern.

2. The engraved cylinder of claim 1 wherein said protective stratum includes nickel.

3. The engraved cylinder of claim 1 wherein said protective stratum is bimetallic.

4. The engraved cylinder of claim 3 wherein the bimetallic stratum includes nickel.

5. The engraved cylinder of claim 1 wherein said protective straum is an alloy.

6. The engraved cylinder of claim 5 wherein said alloy includes nickel.

7. The engraved cylinder of claim 1 wherein said protective stratum is deposited to a thickness of at least about 0.002 inch.

8. The engraved cylinder of claim 1 wherein said superstratum includes nickel as a minority component.

9. The engraved cylinder of claim 8 wherein said superstratum includes nickel oxide as a minority component.

10. The engraved cylinder of claim 1 wherein said superstratum includes aluminum oxide.

11. The engraved cylinder of claim 10 wherein said superstratum includes nickel as a minority component.

12. The engraved cylinder of claim 11 wherein said superstratum includes nickel oxide as a minority component.

13. The engraved cylinder of claim 10 wherein said ceramic coating includes an oxide of titanium.

14. The engraved cylinder of claim 1 wherein, the abraded, said protective stratum has a thickness of at least about 0.0004 inch.

15. The engraved cylinder of claim 1 wherein said superstratum has a thickness of at least about 0.0008 inch.

16. The engraved cylinder of claim 1 wherein said superstratum has a surface finish within the range of about 100 to about 135 microinches RMS.

17. The engraved cylinder of claim 1 wherein said superstratum has a macrohardness of about Rh15-83–86.

18. The engraved cylinder of claim 1 wherein the volume of said engraved cells is about 30% larger than the volume of said finished-cells.

19. The engraved cylinder of claim 1 wherein said substrate is comprised of copper having a hardness between about 190 and about 210 Vickers.

20. The engraved cylinder of claim 1 wherein:

said protective coating includes nickel and has a thickness after abrasion of at least about 0.0004 inch;

said ceramic coating includes an aluminum oxide and has a thickness of at least about 0.0008 inch, a macrohardness of about Rh15-83-86, and a surface finish within the range of about 100 to about 135 microinches RMS; and, wherein the volume of said engraved cells is about 30% larger than the volume of said finished cells.

21. A method of coating a base cylinder to provide an engraved cylinder for use as a carrier for transfer and application of coating liquids, said method including the following steps performed in the order indicated:

(a) applying an engravable substrate on said base cylinder, said substrate being suited to have cells engraved therein;

(b) engraving a cell pattern on said substrate to provide an engraved substrate having an engraved pattern of cells thereon wherein each cell has a given cell volume;

(c) depositing a protective stratum on said engraved substrate;

(d) abrading said protective stratum; and, (e) depositing a ceramic superstratum over the abraded surface of said protective stratum to provide on said engraved cylinder a finished cell pattern of finished cells wherein each finished cell has a given finished-cell volume, said finished-cell pattern conforming to said engraved pattern of cells so that said finished-cell volumes are less than the cell volumes of the cells in said engraved pattern.

22. The method of claim 21 wherein said protective stratum is deposited to a thickness of at least about 0.002 inch.

23. The engraved cylinder of claim 22 wherein, after abrasion, said protective stratum has a thickness of at least about 0.0004 inch.

24. The engraved cylinder of claim 21 wherein, after abrasion, said protective stratum has a thickness of at least about 0.0004 inch.

25. The method of claim 21 wherein said superstratum is deposited to a thickness of at least about 0.0008 inch.

26. The method of claim 21 wherein said superstratum is finished to within a range of about 100 to 135 microinches RMS.

27. The method of claim 21 wherein said superstratum has a macrohardness of about Rh15-83-86.

28. The method of claim 21 wherein said step of applying an engravable substrate includes the deposition of copper to result in said copper having a hardness of between about 190 and about 210 Vickers.

29. The method of claim 21 wherein the deposition of said protective stratum and superstratum are such that the volume of said engraved cells is about 30% larger than the volume of said finished cells.

30. The method of claim 21 wherein the step of applying an engravable substrate is sequentially followed by grinding and polishing of the outer surface of said substrate prior to said engraving step.

31. The method of claim 21 wherein said abrading step includes sandblasting with ultra-fine grit.

32. The method of claim 21 wherein said engraving step is executed by electronic engraving.

* * * * *